United States Patent [19]

Wilson

[11] Patent Number: 4,479,436

[45] Date of Patent: Oct. 30, 1984

[54] DEVICE FOR IGNITING SAFETY FUSE

[76] Inventor: Douglas G. Wilson, 11 Edward St., Upper Ferntree Gully, Vic., 3156, Australia

[21] Appl. No.: 441,151

[22] Filed: Nov. 12, 1982

[30] Foreign Application Priority Data

Jan. 15, 1982 [AU] Australia ..... PF2298

[51] Int. Cl.[3] ..... F42B 3/10

[52] U.S. Cl. ..... 102/275.11; 102/200; 102/204; 102/272

[58] Field of Search ..... 102/275.11, 275.12, 102/275.6, 275.4, 272, 274, 204, 200, 275.9; 42/1 R, 70 R, 90

[56] References Cited

U.S. PATENT DOCUMENTS

| | | | |
|---|---|---|---|
| 997,800 | 7/1911 | Fuller | 102/275.11 |
| 2,771,696 | 11/1956 | Kopf et al. | 42/1 R |
| 3,564,950 | 2/1971 | Jorczak et al. | 42/1 R |
| 4,037,537 | 7/1977 | Thorsell et al. | 102/272 |
| 4,381,710 | 5/1983 | Wätterbäck | 102/200 |
| 4,381,711 | 5/1983 | Lawrence | 102/275.11 |

FOREIGN PATENT DOCUMENTS

| | | | |
|---|---|---|---|
| 2525718 | 6/1975 | Fed. Rep. of Germany | 102/275.6 |
| 2920135 | 5/1979 | Fed. Rep. of Germany | 102/275.6 |

*Primary Examiner*—David H. Brown

*Attorney, Agent, or Firm*—Larson and Taylor

[57] ABSTRACT

A device for igniting an article, such as safety fuse is disclosed having a body portion, (14) a chamber block (43) received in said body portion, said chamber block being movable relative to said body portion, said chamber block having a chamber (48) for receiving an igniter, and said device having an aperture (72) for receiving the article therein or adjacent to which the article can be located, said chamber block being movable from one position in which the igniter can be loaded into the chamber to a second position in which the igniter can be fired, the chamber and aperture being in communication at least when the chamber block is in the second position, a spring biased striker (26, 28) for firing said igniter to thereby ignite said article. The device also has a jaw (70) leading to the aperture to hold the article and a cleaning and ejector tool in said device which may be removed to clean the chamber block and eject spent igniters from the block.

6 Claims, 12 Drawing Figures

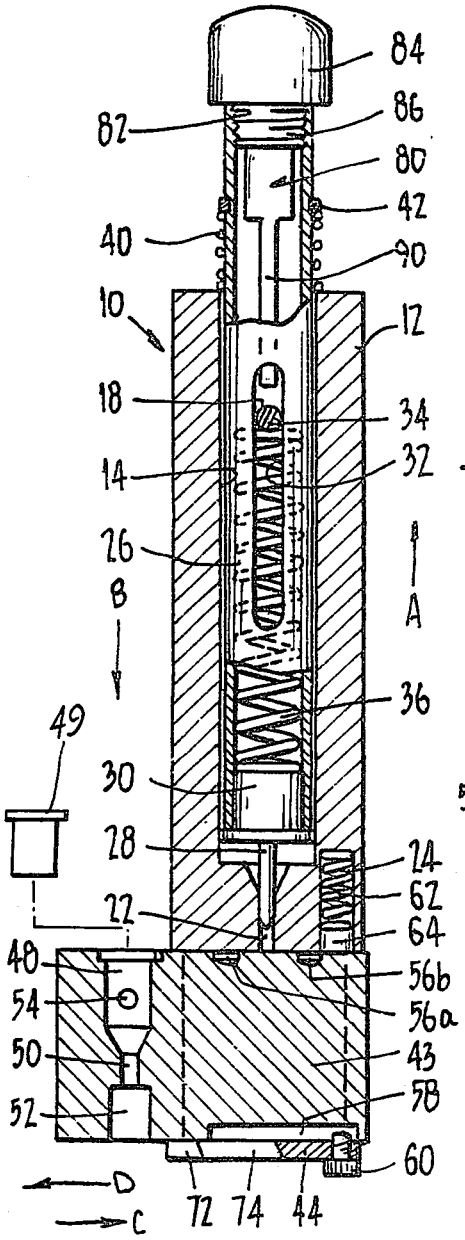
FIG. 3.
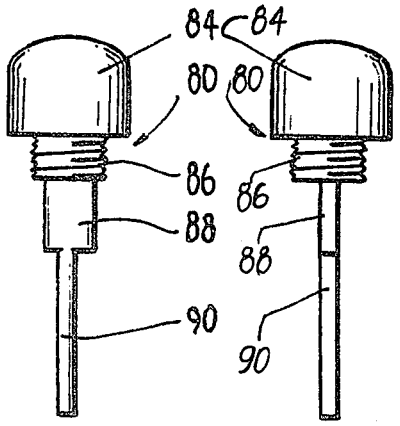
FIG. 4A. FIG. 4B.
FIG. 6A.
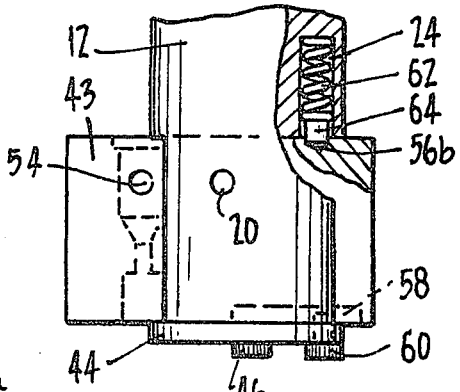
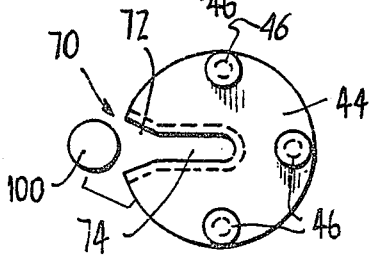
FIG. 6B.

DEVICE FOR IGNITING SAFETY FUSE

This invention relates to a device for igniting articles such as safety fuse.

Safety fuse is commonly used to detonate explosive but suffers from the disadvantage that it is difficult to ignite particularly in wet and windy conditions. Indeed to ignite the safety fuse in wet and windy conditions it is usually necessary to hold the end of the fuse and a match head together and rub the fuse and match head on a lighting surface of a match box or the like. This can be a difficult operation to perform and in wet conditions is not always successful in igniting the fuse.

The object of the present invention is to provide a device which will reliably ignite a safety fuse in all conditions.

The present invention provides a device for igniting an article such as a safety fuse, said device having a body portion, a chamber block received in said body portion, said chamber block being movable relative to said body portion, said chamber block having a chamber for receiving an igniter, and said device having an aperture for receiving the safety fuse therein, said chamber block being movable from one position in which the igniter can be loaded into the chamber to a second position in which the igniter can be fired, the chamber and aperture being in communication at least when the chamber block is in the second position, and firing means for firing said igniter to thereby ignite said safety fuse. Preferably the device has a retaining means for retaining the article in said aperture.

The present invention also provides a device for igniting an article such as a safety fuse, said device having a body portion, a chamber block portion in said body portion, said chamber block portion having a chamber for receiving an igniter, and said device having an aperture for receiving the safty fuse therein, the chamber and aperture being in communication at least when the device is to be fired to light the article, firing means for firing said igniter to thereby ignite said article, retaining means for retaining the article in or adjacent to said aperture.

The invention may also provide a device for igniting an article such as a safety fuse, said device having a body portion, a chamber block having a chamber for receiving an igniter, an aperture for receiving the fuse, said chamber and aperture being in communication at least in one position of the block, firing means for firing the igniter to ignite the fuse, and a cleaning and ejector tool in said device which may be removed to clean the chamber block and eject spent igniters from the block.

The safety fuse is always ignited by the above device since the device fires an igniter which ignites the fuse, and the igniter and the fuse are positively held in the device out of the weather. If the fuse is wet or it is desired to light the fuse in wet conditions it is only necessary to cut off the wet end of the fuse so that dry powder is exposed. A user can then bend over the device and fuse to prevent the end of the fuse from becoming wet due to rain, and place the dry end of the fuse in the aperture.

Preferably said chamber block is slidable relative to the body to expose said chamber in said one position for loading an igniter, is then slidable into an intermediate position in which the igniter is retained in the chamber by virtue of the chamber overlapping a part of the body portion so that the device can be inverted to easily locate the safety fuse in the aperture without losing the igniter, and then is movable into said second position.

Preferably the aperture is provided in the chamber block and the chamber and aperture are joined by a flash hole so that the chamber and aperture are always in communication with one another. The chamber block is preferably located in a slot provided in one end of the body portion and is of rectangular configuration. A plate is connected to the end of the block, said plate having the retaining means which is preferably an elongate jaw provided with a converging entrance. When the fuse is placed in the aperture and the block moves to the second position the fuse is forced into the jaw and held firmly by the jaw so that it is not blown out of the aperture upon firing of the igniter.

Preferably the igniter is a short 0.22 R.F. primed cap (with lead and powder omitted).

Preferably the firing means comprises a striker having a firing pin which is forced against the cap to fire the cap.

A preferred embodiment of the invention will be described with reference to the accompanying drawings in which:

FIG. 3 is a cross-sectional view including the chamber block;

Figure 2:
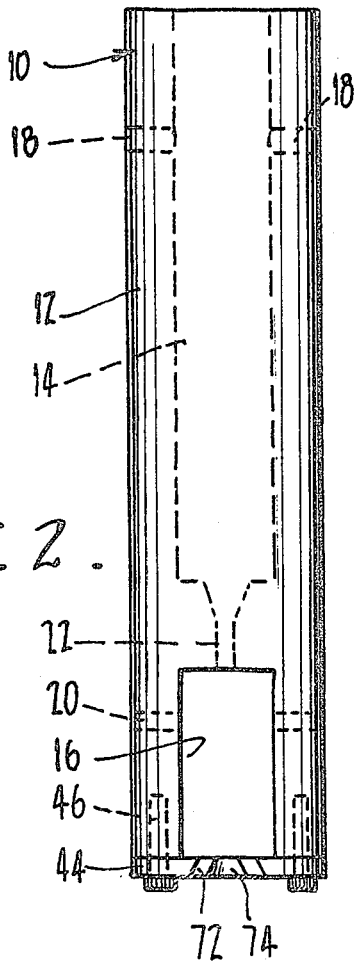
FIG. 2 is a side elevation of the embodiment of FIG. 1.
Figure 5A:
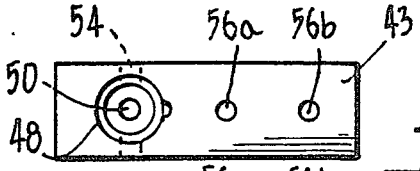
Figure 7A:
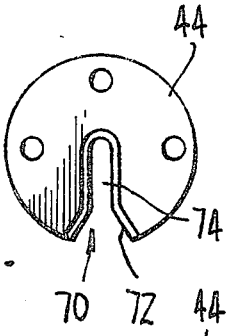
Figure 7B:
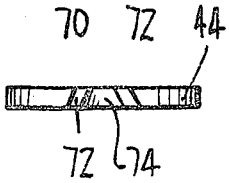

FIGS. 4A and B are front and side view showing an ejector and cleaning tool;

FIGS. 5A, B and C are an elevation, side and bottom view of the chamber block;

FIGS. 6A and B are a view of the chamber block in the intermediate position and a bottom view of the plate showing the retaining jaw; and FIGS. 7A and 7B are a bottom and side view of the retaining plate in the position shown in FIG. 2.

Figure 1:
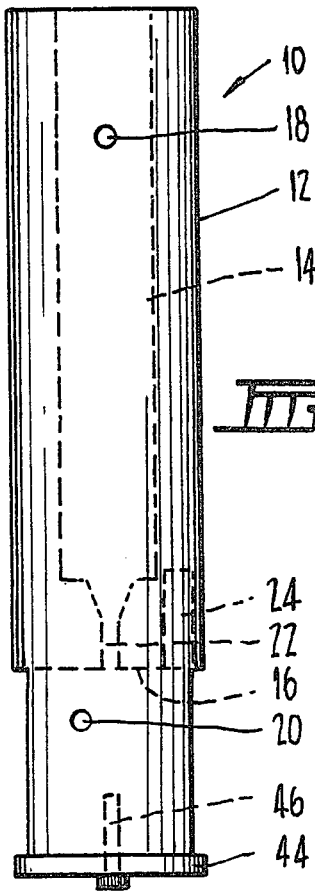
FIG. 1 is a front elevation of a device embodying the invention (with chamber block omitted)

With reference to FIGS. 1 and 2 the device 10 comprises a body portion 12 which can have knurled surfaces for ease of grip. The body portion 12 has an elongate bore 14, a transverse slot 16 and two small transverse holes 18 and 20. The bore 14 has a passage 22 which communicates with the slot 16. A further bore 24 is provided in the body portion 12 which also communicates with the slot 16.

The bore 14 as shown in FIG. 3, includes a striker 26 which is tubular in form and has a firing pin 28 securely fastened at one end in a base plug 30 of the striker 26. The striker 26 has a slot 32 which extends in the axial direction of the striker. A pin 34 is passed through hole 18 and slot 32 and a striker spring 36 is located in the striker 26 between base plug 30 and the pin 34. The striker spring 36 can therefore be compressed between plug 30 and pin 34 upon movement of striker 26 in the direction of arrow A in FIG. 3. The pin 34 also prevents the striker 26 from being drawn all the way out of body 12. Movement in the direction of arrow A ceases when the pin 34 engages the bottom of slot 32 or when the spring 36 is fully compressed. In the position shown in FIG. 3, the spring 36 is in slight compression. A rebound spring 40 is located between an circlip or the like 42 at the top of the striker 26 the body portion 12 of the device to ensure that the firing pin is biased out of the slot 16 when the device is not being fired. This ensures that the firing pin 28 does not interfere with movement of a chamber block 43 to be described hereinunder.

Figure 5B:
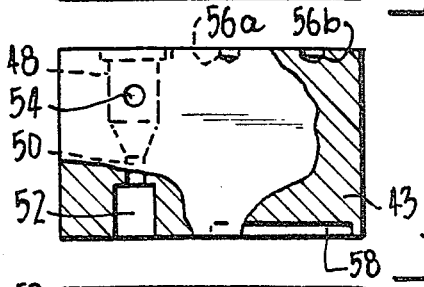
Figure 5C:
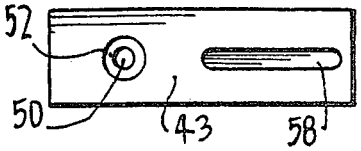

The chamber block 43 (FIGS. 3, 5 and 6) is located in slot 16 and the end of the slot 16 is closed by a plate 44. The plate 44 is secured to the body portion 12 by screws 46. Chamber block 43 is provided with a chamber 48, a flash hole 50 and an aperture 52. The chamber 48 has a gas vent hole 54 and a tapered bottom portion. The hole 54 communicates with hole 20 when the block is in the second position to be described hereinunder. The indents 56*a* and 56*b* and a groove 58 are provided in the block 43. The chamber block 43 is movably retained in the slot 16 by a screw 60 which projects through plate 44 into groove 58 so that the block 43 can move in the direction of arrows C and D. The screw 60 and groove 58 also limit the amount of movement of the block 43.

The bore 24 has a detent plunger 64 and a spring 62 which tends to bias the plunger out of the bore 24.

In order to load a cap into chamber 48, the chamber block is made to slide in groove 16 into the position shown in FIG. 3. This can be done by simple thumb pressure on the block 43. In this position the block is at its limit of movement to the left (as shown in FIG. 3) allowed by screw 60 and groove 58. A cap 49 can now be easily chambered in chamber 48. The block is then moved to the right in FIG. 3 until the detent plunger 64 is located in the indent 56*b*. This is the intermediate position of the block 43. In this position shown in FIG. 6A the chamber 48 is slightly within the confines of body 12 and therefore overlaps the body 12 and accordingly the cap 49 which is chambered in chamber 48 cannot slip out of the chamber. The device therefore may be inverted without fear of loosing the cap 49. Inversion of the device will make it easier to insert a fuse into aperture 52.

The plate 44 is provided with a jaw 70 which has a converging entrance 72 (relative to the exterior of the plate) and an elongate portion 74 which extends in the direction of movement of the block 43. The elongate portion 74 is narrower than the diameter of the safety fuse 100 and the entrance 72 and elongate portion 74 are in the form of a knife edge as best seen in FIG. 7B. It should be clear from FIGS. 6A, 6B, 7A and 7B that in the intermediate position of the block 43 shown in FIG. 6A the fuse 100 can be placed in the aperture 52 as a small part of the aperture overlaps the entrance 72 to the jaw 70 and therefore allows easy insertion of the fuse into the aperture 52. The converging entrance also tends to guide the fuse 100 into the elongate part 74 of the jaw upon movement of the chamber block 43 and also progressively cuts into the fuse 100 so that thumb pressure only is sufficient to move the chamber block 43. When the fuse has been placed in aperture 52 the block is moved to the right in FIGS. 3 and 6 into its second position in which the detent plunger 64 is located in indent 56*a* to hold the block in its position. Once again the block can be moved by simple thumb pressure. As the block moves the fuse is driven into jaw 70 and the knife edge of the jaw cuts into the fuse to securely hold the fuse in the aperture 52.

In the second position (not shown) of the block 43 the passage 22 is in alignment with the chamber 48 so that firing pin 28 is above the cap rim in the chamber.

To ignite the fuse 100 the striker is drawn in the direction of arrow A (FIG. 3) to further compress the spring 36 as the striker 26 moves relative to pin 34 which is accommodated in slot 32. The lower part of spring 40 is not connected to body portion 12 and is merely drawn away from the body with the striker 26. The striker 26 is then released and the striker is biased by spring 36 in the direction of arrow B. It should be noted from FIG. 3 that the slot 32 extends above pin 34 so that striker is able to move a sufficient distance for the firing pin 28 to engage a cap chambered in chamber 48. The bias of spring 36 is sufficient to force the striker 26 and firing pin 28 beyond the position shown in FIG. 3 so that the firing pin can engage the cap. The firing pin 28 therefore passes through passage 22 and abuts the cap in the chamber 48. This produces a flash which is communicated to the fuse in aperture 54 by a flash hole 50 to thereby ignite the fuse. The vent hole 54 and hole 20 are covered when a short 0.22 cap is chambered in the chamber. Any gases produced on firing of the cap pass out of the chamber 48 through flash hole 50, past fuse 100 in chamber 52 and then to atmosphere. This ensures that the flash from the cap passes to the fuse and ignites the same. The purpose of the hole 54 and hole 20 is to allow gases to escape if a low power bullet such as a Palor cap is fired in the device. If a Palor cap is fired in the device the projectile would block flash hole 50 and gases can escape through holes 54 and 20 thereby preventing any chance of the block 43 blowing up. The block 43 can then be pushed into the intermediate or first position and the ignited fuse may then be withdrawn from the aperture 52.

The device also includes a combined cleaning and ejector rod tool 80 which is located in the top of striker 26. The striker 26 is hollow and includes a screw thread 82 on its interior upper end. The tool 80 has an end 84, a screw thread portion 86, a cleaning portion 88 and an ejector portion 90. The cleaning portion is dimensioned to be about the same size as chamber 48 so that it can enter the chamber and scrape the sides of the same to clean the chamber. The ejector portion 90 can be used to push fired caps from the chamber as well as to clean residue from the flash hole 50 etc.

The tool 80 fits into the top of the striker 26 and when in place the top 84 of the tool forms the top of the striker 26. The top 84 can be knurled to allow it to be easily unscrewed from the striker 26.

The device as shown in the drawings is safe to use and cannot be used as a fire arm since the plate 44 will not allow a projectile to leave the block. The flash hole which is of narrow diameter will also not allow a projectile to leave the block. The chamber is preferably dimensioned so that it will accommodate a primed 0.22 cap (short) but not a 0.22 bullet so that a bullet cannot be loaded into the block 43. The chamber 48 and aperture 52 could be dog-legged to further prevent the possibility of the device being used as a fire arm.

It should be evident that the device will reliably ignite a safety fuse in all conditions including windy and wet conditions. However in wet conditions it is recommended that the fuse, if wet, be cut to expose dry powder and then inserted into aperture 52. If the device is being used in the rain, a user's body can be used to shield the dry end of the fuse as it is cut and inserted into the aperture by simply bending over the device.

The device according to the invention can be easily disassembled by removing pin 34 so that striker 26 can be removed from body 12. The chamber block 43 can be removed from the body by loosening or removing screw 60 and sliding the block 43 out of slot 16. The spring 36 can be removed by removing tool 80 and simply sliding the spring out of striker 26.

The length of chamber block 43 can be increased slightly so that the block extends further out of the slot 16 when in the loading position to make it easier to load the device with a loading tool if desired. The length of the groove 58 would be increased by the same amount. The diameter of the recess above chamber 48 is preferably 0.320".

The device of the invention may also be used for other purposes than lighting safety fuse. For example it could be used to light fires particularly in adverse weather conditions or indeed to ignite any article which may be placed adjacent to or in the aperture of the device.

Since modifications within the spirit and scope of the invention may readily be effected by persons skilled within the art, it is to be understood that this application is not limited to the particular embodiment ddescribed by way of example hereinabove.

The claims defining the invention are as follows:

I claim:

1. A device for igniting an article, said device having a body portion, a chamber block received in said body portion, said chamber block being movable relative to said body portion, said chamber block having a chamber for receiving an igniter, and said device having an aperture for receiving an article therein or adjacent to which an article can be located, said chamber block being movable from one position in which an igniter can be loaded into the chamber to a second position in which an igniter loaded in said chamber can be fired, the chamber and aperture being in communication when the chamber block is in the second position, firing means for firing an igniter loaded in said chamber to thereby ignite an article received in said aperture, and retaining means for retaining an article in the aperture, said retaining means comprising an elongate jaw open at one end and provided with a cutting edge so that an article can be forced into the jaw and the cutting edge will cut into an article to retain an article.

2. A device for igniting a safety fuse, said device having a body portion, a chamber block received in said body portion, said chamber block being movable relative to said body portion, said chamber block having a chamber for receiving an igniter, and said device having an aperture for receiving a safety fuse therein, said chamber block being movable from one position in which an igniter can be loaded into the chamber to a second position in which an igniter loaded in said chamber can be fired, the chamber and aperture being in communication when the chamber block is in the second position, retaining means for retaining a safety fuse in said aperture and firing means for firing said igniter to thereby ignite said safety fuse, said chamber block being slidable relative to the body to expose said chamber in said one position for loading an igniter, being slidable into an intermediate position in which an igniter loaded in said chamber is retained in the chamber by virtue of the chamber overlapping a part of said body portion so that the device can be inverted to easily locate a safety fuse in said aperture without losing an igniter, and being then movable into said second position.

3. A device according to claim 2 wherein said retaining means comprises an elongate jaw provided with a converging entrance so that when a safety fuse is placed in the aperture and the block is moved to the second position a retained fuse is forced into the jaw and held firmly by the jaw so that it is not blown out of the aperture upon firing of an igniter loaded in said chamber.

4. A device according to claim 1 or claim 2 wherein the chamber block is located in a slot provided in one end of the body portion and is of rectangular configuration.

5. A device according to claim 1 or claim 2 wherein a plate is connected to the end of the body portion, said retaining means being provided on said plate.

6. A device according to claim 1 or claim 2 wherein the firing means comprises a striker having a firing pin which is forcible against an igniter loaded in said chamber to fire an igniter.

* * * * *